US008407993B2

(12) United States Patent
Vigholm et al.

(10) Patent No.: US 8,407,993 B2
(45) Date of Patent: Apr. 2, 2013

(54) METHOD FOR CONTROLLING A HYDRAULIC CYLINDER IN A WORK MACHINE

(75) Inventors: Bo Vigholm, Stora Sundby (SE); Markku Palo, Eskilstuna (SE)

(73) Assignee: Volvo Construction Equipment AB, Eskilstuna (SE)

( * ) Notice: Subject to any disclaimer, the term of this patent is extended or adjusted under 35 U.S.C. 154(b) by 869 days.

(21) Appl. No.: 12/097,917

(22) PCT Filed: Jan. 16, 2007

(86) PCT No.: PCT/SE2007/000041

§ 371 (c)(1),
(2), (4) Date: Jun. 18, 2008

(87) PCT Pub. No.: WO2007/081281

PCT Pub. Date: Jul. 19, 2007

(65) Prior Publication Data

US 2008/0295504 A1 Dec. 4, 2008

Related U.S. Application Data

(60) Provisional application No. 60/759,996, filed on Jan. 18, 2006.

(30) Foreign Application Priority Data

Jan. 16, 2006 (SE) ..... 0600087

(51) Int. Cl.
*F16D 31/02* (2006.01)

(52) U.S. Cl. ..... 60/327; 60/414; 60/476

(58) Field of Classification Search ..... 60/327, 60/414, 476

See application file for complete search history.

(56) References Cited

U.S. PATENT DOCUMENTS

| | | | | |
|---|---|---|---|---|
| 4,046,270 | A | 9/1977 | Baron et al. | |
| 6,481,202 | B1 * | 11/2002 | Zuehlke et al. | 60/475 |
| 6,502,393 | B1 | 1/2003 | Stephenson et al. | |
| 7,089,733 | B1 | 8/2006 | Jackon et al. | |
| 2002/0125052 | A1 | 9/2002 | Naruse et al. | |
| 2004/0055289 | A1 | 3/2004 | Pfaff et al. | |
| 2005/0066655 | A1 | 3/2005 | Aarestad et al. | |
| 2005/0103006 | A1 | 5/2005 | Yoshino | |

FOREIGN PATENT DOCUMENTS

| | | | |
|---|---|---|---|
| JP | 2003120616 | A | 4/2004 |
| WO | 2006107242 | A1 | 10/2006 |

* cited by examiner

*Primary Examiner* — Daniel Lopez
(74) *Attorney, Agent, or Firm* — WRB-IP LLP

(57) ABSTRACT

A method is provided for controlling a hydraulic cylinder in a work machine, which hydraulic cylinder is arranged to move an implement in relation to a part of a vehicle, with the hydraulic cylinder being controlled by a hydraulic machine. The method includes the steps of detecting initiation of a movement of the implement that is such that the piston of the hydraulic cylinder is moved in a first direction, of driving the hydraulic machine in a first rotational direction, prior to the movement of the implement taking place, so that a line from the hydraulic machine is pressurized, which line is arranged to connect the hydraulic machine to the side of the cylinder toward which the piston will be moved during the movement of the implement.

14 Claims, 4 Drawing Sheets

METHOD FOR CONTROLLING A HYDRAULIC CYLINDER IN A WORK MACHINE

The present application is the U.S. National Stage of International Application PCT/SE2007/000041, filed Jan. 16, 2007, which claims benefit of U.S. Provisional Application 60/759,996, filed Jan. 18, 2006, and claims priority to SE 0600087-1, filed Jan. 16, 2006, all of which are incorporated by reference.

BACKGROUND AND SUMMARY

The present invention relates to a method for controlling at least one hydraulic cylinder in a work machine, which hydraulic cylinder is arranged to move an implement in relation to a part of a vehicle, with the hydraulic cylinder being controlled by a hydraulic machine.

The invention will be described below in connection with a work machine in the form of a wheel loader. This is a preferred but in no way limiting application of the invention. The invention can also be used for other types of work machines (or work vehicles), such as an excavator loader (backhoe) and excavating machine.

The invention relates, for example, to controlling lifting and/or tilting cylinders for operating an implement.

More precisely, the invention relates to a control system which comprises a hydraulic machine which functions as both pump and motor. The hydraulic machine is connected in a driving manner to an electric machine which functions as both motor and generator.

The hydraulic machine therefore functions as a pump in a first operating state and supplies pressurized hydraulic fluid to the hydraulic cylinder. The hydraulic machine also functions as a hydraulic motor in a second operating state and is driven by a hydraulic fluid flow from the hydraulic cylinder. The electric machine therefore functions as an electric motor in the first operating state and as a generator in the second operating state.

The first operating state corresponds to a work operation, such as lifting or tilting, being carried out with the hydraulic cylinder. Hydraulic fluid is therefore directed to the hydraulic cylinder for movement of the piston of the cylinder. On the other hand, the second operating state is an energy recovery state.

It is desirable to achieve a method for controlling a hydraulic cylinder, preferably for a lift function and/or tilt function, that provides smooth operation and means that the driver is subjected to fewer shocks and jerks.

According to an aspect of the present invention, a method is provided comprising the steps of detecting initiation of a movement of the implement that is such that the piston in the hydraulic cylinder is moved in a first direction, of driving the hydraulic machine in a first rotational direction, prior to the movement of the implement taking place, so that a line from the hydraulic machine is pressurized, which line is arranged to connect the hydraulic machine to the side of the cylinder toward which the piston will be moved during the movement of the implement.

The fact that the movement of the implement has been initiated is preferably detected directly via an input from an operator of the vehicle, such as a movement of a lifting lever.

The method is primarily applicable for a lowering movement of a load to avoid shocks, but can also be utilized for a lifting movement of the load arm on the work machine, or alternatively for a tilting movement of the implement.

Further preferred embodiments and advantages of the invention emerge from the following description.

BRIEF DESCRIPTION OF THE DRAWINGS

The invention will be described in greater detail below with reference to the embodiments shown in the accompanying drawings, in which.

DETAILED DESCRIPTION

Figure 1:
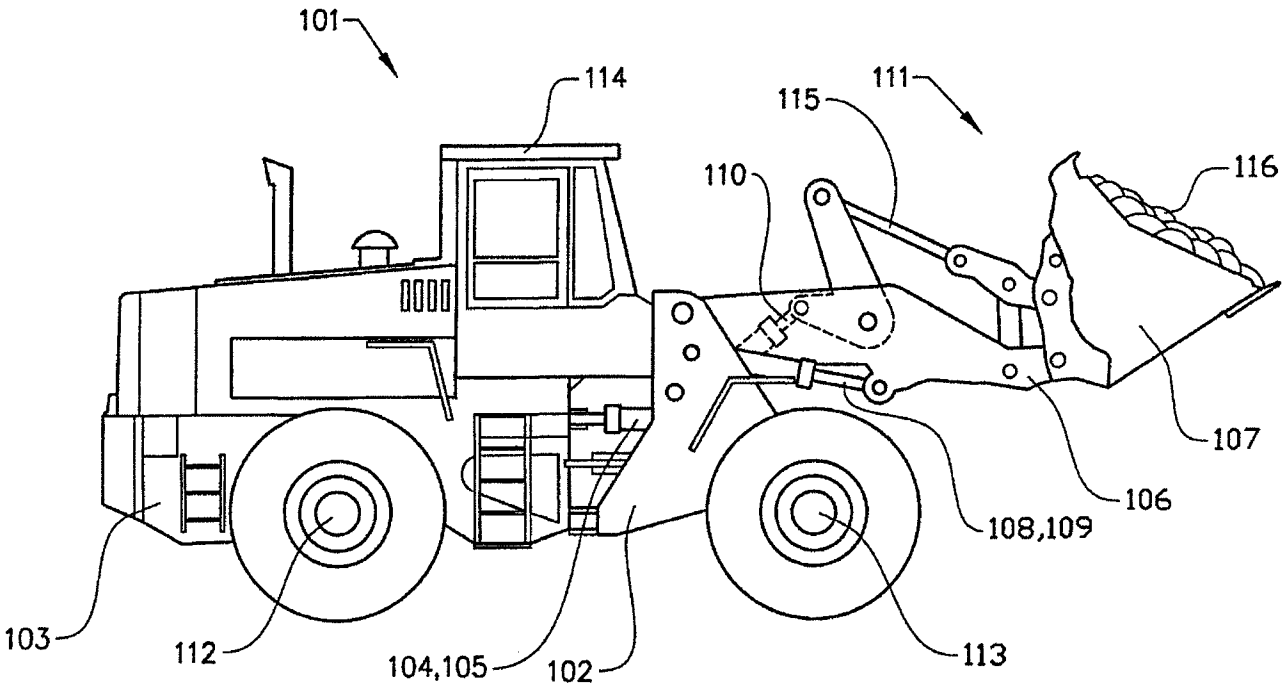
FIG. 1 shows a side view of a wheel loader.

FIG. 1 shows a side view of a wheel loader 101. The wheel loader 101 comprises a front vehicle part 102 and a rear vehicle part 103, which parts each comprise a frame and a pair of drive axles 112, 113. The rear vehicle part 103 comprises a cab 114. The vehicle parts 102, 103 are coupled together with one another in such a way that they can be pivoted in relation to one another about a vertical axis by means of two hydraulic cylinders 104, 105 which are connected to the two parts. The hydraulic cylinders 104, 105 are thus arranged on different sides of a center line in the longitudinal direction of the vehicle for steering, or turning the wheel loader 101.

The wheel loader 101 comprises an apparatus 111 for handling objects or material. The apparatus 111 comprises a lifting arm unit 106 and an implement 107 in the form of a bucket which is mounted on the lifting arm unit. Here, the bucket 107 is filled with material 116. A first end of the lifting arm unit 106 is coupled rotatably to the front vehicle part 102 for bringing about a lifting movement of the bucket. The bucket 107 is coupled rotatably to a second end of the lifting arm unit 106 for bringing about a tilting movement of the bucket.

The lifting arm unit 106 can be raised and lowered in relation to the front part 102 of the vehicle by means of two hydraulic cylinders 108, 109, which are each coupled at one end to the front vehicle part 102 and at the other end to the lifting arm unit 106. The bucket 107 can be tilted in relation to the lifting arm unit 106 by means of a third hydraulic cylinder 110, which is coupled at one end to the front vehicle part 102 and at the other end to the bucket 107 via a link arm system.

An embodiment of a control system for the hydraulic functions of the wheel loader 101 will be described in greater detail below. This embodiment relates to lifting and lowering of the lifting arm 106 via the lifting cylinders 108, 109, see FIG. 1. However, this embodiment of the control system could also be used for tilting the bucket 107 via the tilting cylinder 110.

Figure 2:
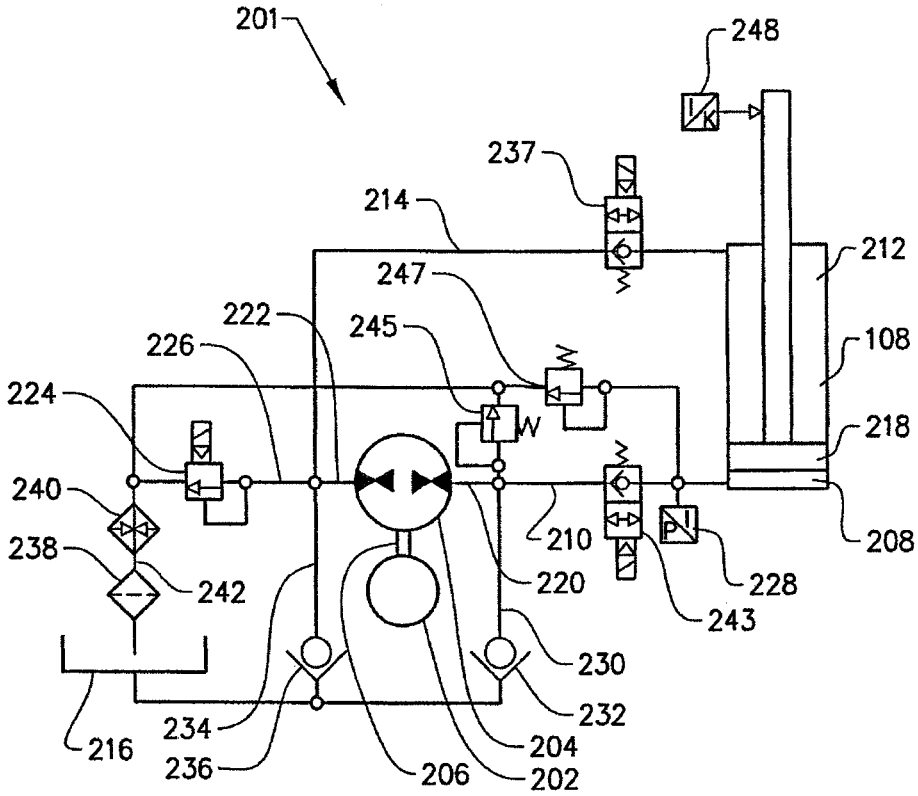
FIG. 2 shows a preferred embodiment of a control system for controlling a work function of the wheel loader.

FIG. 2 shows an embodiment of a control system 201 for performing lifting and lowering of the lifting arm 106, see FIG. 1. The hydraulic cylinder 108 in FIG. 2 therefore corresponds to the lifting cylinders 108, 109 (although only one cylinder is shown in FIG. 2).

The control system 201 comprises an electric machine 202, a hydraulic machine 204 and the lifting cylinder 108. The electric machine 202 is connected in a mechanically driving manner to the hydraulic machine 204 via an intermediate drive shaft 206. The hydraulic machine 204 is connected to a piston side 208 of the hydraulic cylinder 108 via a first line 210 and a piston-rod side 212 of the hydraulic cylinder 108 via a second line 214.

The hydraulic machine 204 is adapted to function as a pump, be driven by the electric machine 202 and supply the hydraulic cylinder 108 with pressurized hydraulic fluid from a tank 216 in a first operating state and to function as a motor, be driven by a hydraulic fluid flow from the hydraulic cylinder 108 and drive the electric machine 202 in a second operating state.

The hydraulic machine 204 is adapted to control the speed of the piston 218 of the hydraulic cylinder 108 in the first operating state. No control valves are therefore required between the hydraulic machine and the hydraulic cylinder for said control. More precisely, the control system 201 comprises a control unit 402, see FIG. 4, which is electrically connected to the electric machine 202 in order to control the speed of the piston of the hydraulic cylinder 108 in the first operating state by controlling the electric machine.

The hydraulic machine 204 has a first port 220 which is connected to the piston side 208 of the hydraulic cylinder via the first line 210 and a second port 222 which is connected to the piston-rod side 212 of the hydraulic cylinder via the second line 214. The second port 222 of the hydraulic machine 204 is moreover connected to the tank 216 in order to allow the hydraulic machine, in the first operating state, to draw oil from the tank 216 via the second port 222 and supply the oil to the hydraulic cylinder 108 via the first port 220.

In certain situations, such as when it is desired to press a material down or to flatten something, it is necessary to lower the bucket 107 with more force than is the case when only the load drives the movement of the piston 218. Such intensified lowering is usually referred to as "power down". This power down function can also be used for lifting the vehicle. The control system 201 comprises a means 224 for controlling pressure, which pressure means 224 is arranged on a line 226 between the second port 222 of the hydraulic machine 204 and the tank 216 in order to allow pressure build-up on the piston-rod side 212. More precisely, the pressure control means 224 comprises an electrically controlled pressure-limiting valve.

The control system 201 also comprises a sensor 228 for sensing pressure on the piston side 208 of the hydraulic cylinder 108. When a low pressure value is detected on the piston side, the line 226 to the tank is blocked via the pressure-limiting valve 224, which results in the pressure in the line 214 to the piston-rod side being increased and said intensified downward movement (power down) being obtained. During lowering, the pressure sensor registers that the pressure is below a certain level (for example 20 bar) on the piston side. The pressure level on the electrically controlled pressure limiter is then increased to a suitable level so that pressure build-up takes place on the piston-rod side.

The first port 220 of the hydraulic machine 204 is connected to the tank 216 via a first suction line 230. A means 232, in the form of a non-return valve, is adapted to allow suction of hydraulic fluid from the tank and obstruction of a hydraulic fluid flow to the tank through the suction line 230.

The second port 222 of the hydraulic machine 204 is connected to the tank 216 via a second suction line 234. A means 236, in the form of a non-return valve, is adapted to allow suction of hydraulic fluid from the tank and obstruction of a hydraulic fluid flow to the tank through the suction line 234.

A means 237 for opening/closing is arranged on the second line 214 between the second port 222 of the hydraulic machine 204 and the piston-rod end 212 of the hydraulic cylinder 108. This means 237 comprises an electrically controlled valve with two positions. In a first position, the line 214 is open for flow in both directions. In a second position, the valve has a nonreturn valve function and allows flow in only the direction toward the hydraulic cylinder 108. During lifting movement, the electric valve 237 is opened and the rotational speed of the electric machine 202 determines the speed of the piston 218 of the hydraulic cylinder 108. Hydraulic fluid is drawn from the tank 216 via the second suction line 234 and is pumped to the piston side 208 of the hydraulic cylinder 108 via the first line 210.

An additional line 242 connects the second port 222 of the hydraulic machine 204 and the tank 216.

A means 243 for opening/closing is arranged on the first line 210 between the first port 220 of the hydraulic machine 204 and the piston end 208 of the hydraulic cylinder 108. This means 243 comprises an electrically controlled valve with two positions. In a first position, the line 210 is open for flow in both directions. In a second position, the valve has a non-return valve function and allows flow in only the direction toward the hydraulic cylinder 108.

According to a preferred embodiment, for lowering the implement, it is first detected that a lowering movement has been initiated via a movement of a lifting lever 406. The electrical valve 243 is closed. Prior to the lowering movement taking place, the hydraulic machine 204 is driven in a first rotational direction so that the line 210 between the hydraulic machine and the valve 243 is pressurized. More specifically, the hydraulic machine 204 is rotated through a certain angle in the "wrong direction", which angle is sufficient to pressurize said line 210 to a suitable degree. The hydraulic machine is either rotated through a predetermined angle or else the angle is varied depending upon the size of the load. The size of the load can, for example, be detected via the pressure sensor 228.

Thereafter, the valve 243 on the piston side 208 is opened, the direction of rotation of the hydraulic machine 204 is reversed and the lowering movement commences. The electrically controlled pressure limiter may need to be throttled to some extent in order to improve the refilling of the piston-rod side.

The hydraulic machine is thus allowed to rotate in a second rotational direction, opposite to the first rotational direction, whereupon the lowering movement can commence. The applied pressure is thus reduced so that the lowering movement can commence. A flow of hydraulic fluid from the hydraulic cylinder 108 drives the hydraulic machine 204 in the second rotational direction.

In addition, pressurizing can take place by the electric machine 202 firstly being driven with a certain torque in the "wrong direction", with the degree of torque being based upon the value of the pressure sensor 228 immediately prior to this. For example, a signal is received from the electric machine 202 that is indicative of the torque of the hydraulic machine.

According to yet another alternative, the valve 243 is kept open after the detection of the initiation of the movement of the implement. In addition, an operating parameter is detected that is indicative of the pressurizing of the line from the hydraulic machine 204. This operating parameter is preferably indicative of the position of the piston in the hydraulic cylinder. The position is preferably detected by a position sensor 248. The detected value (the position) is compared with a limit value and the pressurizing is terminated if the detected value exceeds the limit value. The limit value corresponds to the piston in the hydraulic cylinder being raised slightly when the electric machine is driven in the first rotational direction (in the "wrong direction"). This indicates that the lowering movement can commence, the pressurizing is terminated and a flow of hydraulic fluid from the hydraulic cylinder 108 drives the hydraulic machine 204 in the second rotational direction.

According to an alternative embodiment, the method is utilized for raising the bucket 107 in relation to the front part 102 of the wheel loader 101. A work operation can require material to be flattened on a base. In order to carry this out, the bucket can be lowered to make contact with the ground and then the lowering movement is continued so that the front wheels lose contact with the ground and the front part 102 of the wheel loader is lifted from the ground. The wheel loader can then be driven either forward or backward in order to flatten the base. In certain cases, with the machine in this position, it can be desirable to raise the load arm slightly in order to gain a grip with the front wheels. For this lifting operation, the piston-rod side is thus pressurized in a corresponding way to that described above for the lowering movement. With the system shown in FIG. 2, it is also possible to cause the pressure-limiting valve 224 to close so that the required pressurizing of the line 214 is obtained.

Figure 3:
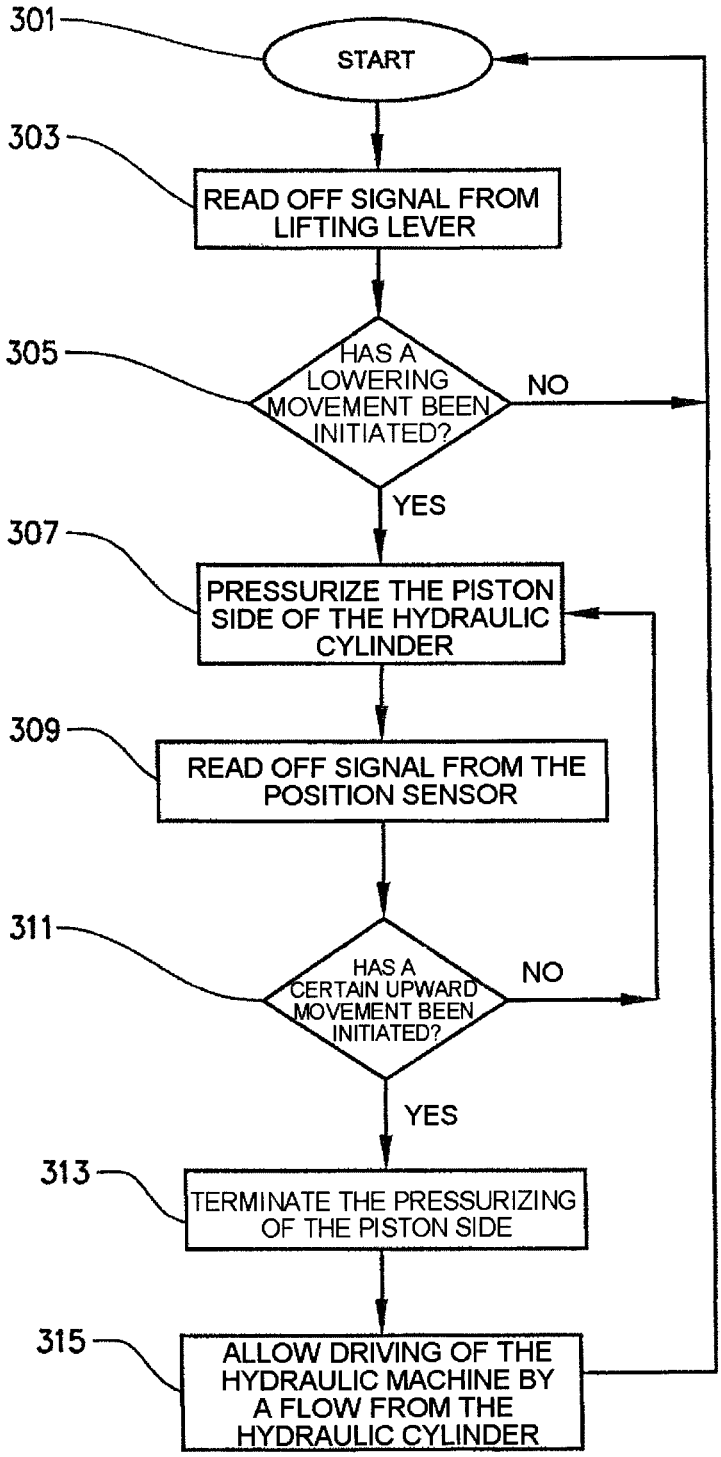
FIG. 3 shows a flow diagram for a lowering of the implement, according to a first example.

FIG. 3 illustrates a flow diagram for the logic circuit in the lowering method. The logic circuit commences at the initial block 301. Following this, the control unit continues to block 303, where a signal from the control lever 406 for the lift function is read off. In the next block 305, it is determined whether a lowering movement has been initiated. If the lowering movement has been initiated, the piston side of the hydraulic cylinder is pressurized by the hydraulic machine being driven by the electric machine, see block 307. Following this, a signal is again read off from the sensor 248 that detects the position of the piston rod, see block 309. If a certain upward movement of the piston rod is detected, see block 311, the driving of the hydraulic machine by the electric machine is terminated, see block 313, and the hydraulic machine is allowed to be driven by a flow from the hydraulic machine, see block 315.

For example, the position of the piston rod in the lifting cylinder is detected by means of a linear sensor. According to an alternative to detecting the position of the piston rod in the lifting cylinder, the angular position of the load arm is detected by means of an angle sensor. According to an alternative or in addition, the position of the implement is detected, for example by the position of the piston rod in the tilting cylinder or by means of an angle sensor. The position parameter is preferably detected repeatedly, suitably essentially continuously, whereby the direction of the piston in the hydraulic cylinder can be determined.

According to an alternative to detecting a movement of a lifting lever 406 for initiating the method, an input can be received from another control device, such as an on-board computer, which can be the case with a driverless machine.

If the bucket 107 should stop suddenly during a lowering movement (which can happen if the bucket strikes the ground), the hydraulic machine 204 does not have time to stop. In this state, hydraulic fluid can be drawn from the tank 216 via the suction line 230 and on through the additional line 242.

The electrically controlled valves 237, 243 function as load-holding valves. They are closed in order that electricity is not consumed when there is a hanging load and also in order to prevent dropping when the drive source is switched off. According to an alternative, the valve 237 on the piston-rod side 212 is omitted. However, it is advantageous to retain the valve 237 because external forces can lift the lifting arm 106.

A filtering unit 238 and a heat exchanger 240 are arranged on the additional line 242 between the second port 222 of the hydraulic machine 204 and the tank 216. An additional filtering and heating flow can be obtained by virtue of the hydraulic machine 204 driving a circulation flow from the tank 216 first via the first suction line 230 and then via the additional line 242 when the lifting function is in a neutral position. Before the tank, the hydraulic fluid thus passes through the heat exchanger 240 and the filter unit 238.

There is another possibility for additional heating of the hydraulic fluid by pressurizing the electrically controlled pressure limiter 224 at the same time as pumping-round takes place to the tank in the way mentioned above. This can of course also take place when the lifting function is used.

In addition, the electrically controlled pressure limiter 224 can be used as a back-up valve for refilling the piston-rod side 212 when lowering is carried out. The back pressure can be varied as required and can be kept as low as possible, which saves energy. The hotter the oil, the lower the back pressure can be, and the slower the rate of lowering, the lower the back pressure can be. When there is a filtration flow, the back pressure can be zero.

A first pressure-limiting valve 245 is arranged on a line which connects the first port 220 of the hydraulic machine 204 to the tank 216. A second pressure-limiting valve 247 is arranged on a line which connects the piston side 208 of the hydraulic cylinder 108 to the tank 216. The two pressure-limiting valves 245, 247 are connected to the first line 210 between the hydraulic machine 204 and the piston side 208 of the hydraulic cylinder 108 on different sides of the valve 243. The two pressure-limiting valves 245, 247, which are also referred to as shock valves, are spring-loaded and adjusted to be opened at different pressures. According to an example, the first pressure-limiting valve 245 is adjusted to be opened at 270 bar, and the second pressure-limiting valve 247 is adjusted to be opened at 380 bar.

When the work machine 101 is driven toward a heap of gravel or stones and/or when the implement is lifted/lowered/tilted, the movement of the bucket may be counteracted by an obstacle. The pressure-limiting valves 245, 247 then ensure that the pressure is not built up to levels which are harmful for the system.

According to a first example, the bucket 107 is in a neutral position, that is to say stationary in relation to the frame of the front vehicle part 102. When the wheel loader 101 is driven toward a heap of stones, the second pressure limiter 247 is opened at a pressure of 380 bar.

During ongoing lowering, the valve 243 on the first line 210 between the hydraulic machine 204 and the piston side 208 of the hydraulic cylinder 108 is open. When the lifting arm 106 is lowered, the first pressure limiter 245 is opened at a pressure of 270 bar. If an external force should force the loading arm 106 upward during a lowering operation with power down, the pressure limiter 224 on the line 226 between the second port 222 of the hydraulic machine 204 and the tank 216 is opened.

According to an alternative to the pressure-limiting valves 245, 247 being adjusted to be opened at a predetermined pressure, the pressure-limiting valves can be designed with variable opening pressure. According to a variant, the pressure-limiting valves 245, 247 are electrically controlled. If electric control is used, only one valve 247 is sufficient for the shock function. This valve 247 is controlled depending on whether the valve 243 is open or closed. The opening pressure can be adjusted depending on activated or non-activated lifting/lowering function and also depending on the cylinder position.

Figure 4:
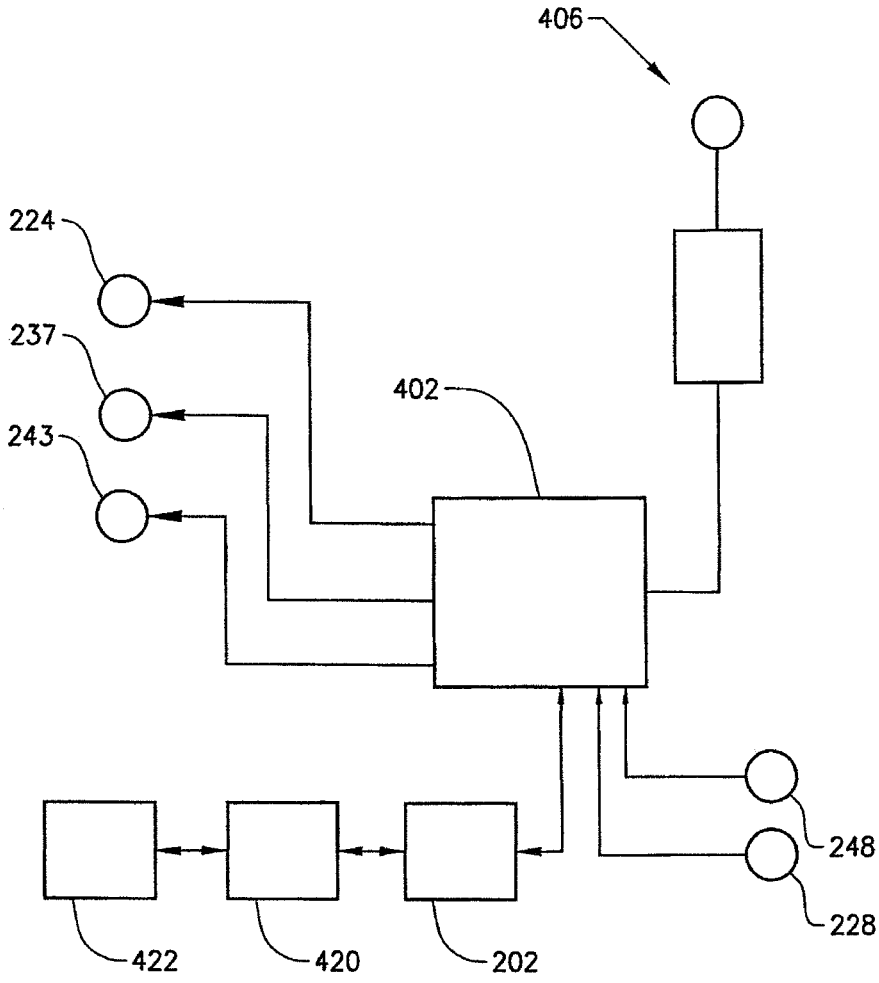
FIG. 4 shows a control system for controlling a function of the wheel loader.

FIG. 4 shows a control system for the lowering function. A control element 406 in the form of a lifting lever is arranged in the cab 114 for manual operation by the driver and is electrically connected to the control unit 402 for controlling the lift functions.

The electric machine 202 is electrically connected to the control unit 402 in such a way that it is controlled by the control unit and can supply operating state signals to the control unit.

The control system comprises one or more energy storage means 420 connected to said electric machine 202. The energy storage means 420 can consist of or comprise a battery or a supercapacitor, for example. The energy storage means 420 is adapted to provide the electric machine with energy when the electric machine 202 is to function as a motor and drive its associated pump 204. The electric machine 202 is adapted to charge the energy storage means 420 with energy when the electric machine 202 is driven by its associated pump 204 and functions as a generator.

The wheel loader 101 also comprises a power source 422 in the form of an internal combustion engine, which usually comprises a diesel engine, for propulsion of the vehicle. The diesel engine is connected in a driving manner to the wheels of the vehicle via a drive line (not shown). The diesel engine is moreover connected to the energy storage means 420 via a generator (not shown) for energy transmission.

It is possible to imagine alternative machines/units adapted for generating electric power. According to a first alternative, use is made of a fuel cell which provides the electric machine with energy. According to a second alternative, use is made of a gas turbine with an electric generator for providing the electric machine with energy.

FIG. 4 also shows the other components which are connected to the control unit 402 according to the first embodiment of the control system for the lifting function, see FIG. 2, such as the electrically controlled valves 224, 237, 243, the position sensor 248 and the pressure sensor 228. It will be understood that corresponding components for the tilting function and the steering function and the additional function are connected to the control unit 402.

The invention is not to be regarded as being limited to the illustrative embodiments described above, but a number of further variants and modifications are conceivable within the scope of the following patent claims.

The invention claimed is:

1. A method for controlling a hydraulic cylinder in a work machine, which hydraulic cylinder is arranged to move an implement in relation to a part of a vehicle, with the hydraulic cylinder being controlled by a hydraulic machine, comprising detecting initiation of a movement of the implement that is such that a piston in the hydraulic cylinder is moved in a first direction, driving the hydraulic machine through a predetermined angle in a first rotational direction, prior to the movement of the implement taking place, so that a line from the hydraulic machine is pressurized, which line is arranged to connect the hydraulic machine to the side of the cylinder toward which the piston will be moved during the movement of the implement.

2. The method as claimed in claim 1, comprising allowing the hydraulic machine to rotate in a second rotational direction, opposite to the first rotational direction, after the pressurizing, whereby movement of the implement can commence and a flow of hydraulic fluid from the hydraulic cylinder drives the hydraulic machine in the second rotational direction.

3. The method as claimed in claim 1, wherein a controllable arrangement for opening and closing a line between the hydraulic machine and the hydraulic cylinder is arranged on the line from the hydraulic machine, comprising keeping the controllable arrangement closed so that it does not allow flow in the direction from the hydraulic cylinder to the hydraulic machine after detection of the initiation of the movement of the implement, and pressurizing a line between the hydraulic cylinder and the controllable arrangement.

4. The method as claimed in claim 3, comprising opening the controllable arrangement after the pressurizing, in order to allow the hydraulic machine to rotate in a second rotational direction, opposite to the first rotational direction, whereupon the movement can commence and a flow of hydraulic fluid from the hydraulic cylinder drives the hydraulic machine in the second rotational direction.

5. The method as claimed in claim 1, comprising driving the hydraulic machine in the first rotational direction, prior to the movement of the implement taking place, so that a side of the hydraulic cylinder is pressurized via the line from the hydraulic machine.

6. The method as claimed in claim 1, comprising driving the hydraulic machine in the first rotational direction, prior to the movement of the implement taking place, so that a piston side of the hydraulic cylinder is pressurized via the line from the hydraulic machine.

7. The method as claimed in claim 1, comprising detecting initiation of the movement of the implement via an input from an operator of the vehicle.

8. The method as claimed in claim 1, comprising detecting an operating parameter that is indicative of pressurizing of the line from the hydraulic machine, comparing the detected value with a limit value and terminating the pressurizing if the detected value exceeds the limit value.

9. A method for controlling a hydraulic cylinder in a work machine, which hydraulic cylinder is arranged to move an implement in relation to a part of a vehicle, with the hydraulic cylinder being controlled by a hydraulic machine, comprising detecting initiation of a movement of the implement that is such that a piston in the hydraulic cylinder is moved in a first direction, driving the hydraulic machine in a first rotational direction, prior to the movement of the implement taking place, so that a line from the hydraulic machine is pressurized, which line is arranged to connect the hydraulic machine to the side of the cylinder toward which the piston will be moved during the movement of the implement, detecting an operating parameter that is indicative of pressurizing of the line from the hydraulic machine, comparing the detected value with a limit value and terminating the pressurizing if the detected value exceeds the limit value and wherein the operating parameter is indicative of a position of the piston in the hydraulic cylinder.

10. The method as claimed in claim 1, wherein the implement is subjected to a load.

11. The method as claimed in claim 1, wherein the movement of the implement is a lowering movement.

12. The method as claimed in claim 1, wherein the line from the hydraulic machine is arranged to connect the hydraulic machine to a piston side of the hydraulic cylinder.

13. The method as claimed in claim 1, wherein the movement of the implement is a lifting movement.

14. The method as claimed in claim 1, wherein the line from the hydraulic machine is arranged to connect the hydraulic machine to a piston-rod side of the hydraulic cylinder.

* * * * *